US005582084A

United States Patent [19]

Sarmiento

[11] Patent Number: 5,582,084

[45] Date of Patent: Dec. 10, 1996

[54] EXTENSION LOCKING PLIERS

[76] Inventor: Pablo A. Sarmiento, 12417 Tesuque Rd., Apple Valley, Calif. 92308

[21] Appl. No.: 491,236

[22] Filed: Jun. 16, 1995

[51] Int. Cl.[6] ..... B25B 7/12

[52] U.S. Cl. ..... 81/345; 81/418; 81/383; 294/19.1

[58] Field of Search ..... 294/19.1; 81/345, 81/383, 418, 421

[56] References Cited

U.S. PATENT DOCUMENTS

| | | | |
|---|---|---|---|
| 1,519,938 | 12/1924 | Smith | 81/345 X |
| 5,174,300 | 12/1992 | Bales et al. | 294/19.1 X |
| 5,380,054 | 1/1995 | Galvis | 294/19.1 X |
| 5,435,214 | 7/1995 | Sisson | 81/383 X |

FOREIGN PATENT DOCUMENTS

| | | | |
|---|---|---|---|
| 132990 | 9/1951 | Sweden | 81/345 |

*Primary Examiner*—James G. Smith
*Attorney, Agent, or Firm*—Timothy T. Tyson

[57] ABSTRACT

An extension locking pliers (20) having jaws (28, 30) remotely located from the handle assembly (22) is disclosed for reaching into positions which would otherwise be difficult, dangerous, or impossible to reach. A stepped radial positioning system (154) allows the jaws to be moved and held in different orientations with respect to the handle assembly. A supplementary extension (240) allows the length between the jaw and handle assembly to be increased as needed.

19 Claims, 3 Drawing Sheets

EXTENSION LOCKING PLIERS

TECHNICAL FIELD

The present invention relates generally to pliers and, in particular, to extension locking pliers having the jaws remotely located from the handle.

BACKGROUND ART

Locking pliers such as the many varieties of locking pliers sold by the Petersen Manufacturing Co., Inc. of Dewitt, Nebr., under the trademark Vise-Grip offer significant advantages to the user in many situations. Locking pliers are described in U.S. Pat. Nos. 2,280,005; 2,514,130; 3,192,804; 4,541,312; 4,546,680; 4,709,601; 5,056,385; and others identified in these patents.

In certain locations, it is awkward or dangerous to use a locking pliers such as where there is moving machinery, heat, electricity, limited access, or a remote position. For example, the smog testing of automobile engines requires attaching a wire lead to a spark plug while the engine is operating and hot. Vacuum and water hoses are clamped shut for some tests while the engine is operating. Locking pliers having the handle remotely located from the jaws would be useful for these conditions.

Extensions for locking pliers have been developed as shown in U.S. Pat. Nos. 4,462,284 and 4,519,278. Both are for manipulating unmodified locking pliers from a distance. The device in U.S. Pat. No. 4,462,284 has an extension handle for each handle of the locking pliers. The resulting overall arrangement is cumbersome. The device in U.S. Pat. No. 4,519,278 requires the locking pliers to be attached to the work piece first and then manipulated from a distance later. Both of these devices therefore have only limited usefulness.

Extensions for non-locking pliers are more prevalent. U.S. Pat. No. 1,519,938 illustrates a pliers having a flexible tube connection between the handles and jaws. A wire inside the tube connects one of the handles to one of the jaws. When the handles are squeezed, the handles pull the wire forcing the jaws together. The pliers have limited utility because the flexible connection between the handles and jaws makes the positioning of the jaws difficult from a distance.

Extension tools having rigid connections between the handles and jaws are easier to position from a distance. All of the devices in the following patents have rigid tubes between the handles and jaws and rigid rods inside for transmitting the motion from the handles to the jaws. The tool in U.S. Pat. No. 1,992,596 has a spring loaded depression button on one end and jaws on the other. When the button is depressed, the fingers open. When the button is released, the spring forces the button back clamping the jaws on a work piece. Of particular interest is the connection between the rod and jaws. The rod projects past the pivot points of the jaws and is connected to each jaw by a rigid hinged link attached to the jaw by a pivot located on the jaw past the end of the rod. The resulting arrangement causes the jaws to open when the button is pushed.

U.S. Pat. No. 2,518,994 discloses a forceps having a rod that closes the jaws by means of an inclined cam operating against one of the jaws. One of the handles pushes the end of the rod. Because of the inclined surface of the rod, the rod must not be allowed to rotate out of proper alignment with the jaw. Of particular interest is the means for maintaining alignment. A pin passes through the walls of the tube and a slot in the rod keeping the rod in alignment with the tube. U.S. Pat. No. 2,532,972 shows a different cam arrangement. The jaws pivot past the end of the rod and each have cam faces. The end of the rod is a cone. When the rod is pushed downs the cone operates against the cam faces closing the jaws. U.S. Pat. No. 2,827,694 shows a tool having a handle that pushes on the end of the rod to engage a contact ball which operates against a cam face on the jaw. Of particular interest in this tool is a threaded quick coupling for changing jaws.

No combination of a locking pliers having the jaws remotely located from the handles has been developed. Such a combination would have many useful purposes.

DISCLOSURE OF INVENTION

The present invention is directed to an extension locking pliers having jaws remotely located from the handles for reaching into positions which are difficult, dangerous, or otherwise impossible to reach. The handle assembly has a form and function similar to the locking pliers commonly sold under the trademark Vise-Grip with first and second arms instead of jaws. At the other end of the extension plier is a slave assembly having the jaws. An extension means between the handle assembly and jaws transmits the movement of the handle assembly into movement of the jaws.

In accordance with a preferred embodiment of the invention, the extension locking pliers is operated entirely by compression forces. A rod in the extension means presses against a slide in the slave assembly forcing the jaws to close through a link to each of the jaws pushing out from the slide.

In accordance with another preferred embodiment of the invention, the jaws are mounted in the slave assembly by a removable jaw pivot. When different jaws or cutters are needed, the operator pushes out the jaw pivot, removes the jaws, links, and slide and substitutes a new set with different jaws or cutters.

In accordance with an important aspect of the inventions, the jaw pivot has an internal spring that engages a groove in the pivot aperture to keep the pivot in place.

In accordance with another preferred embodiment of the invention, a stepped radial positioning means is provided for changing the orientation of the jaws in relation to the handle assembly.

In accordance with an important aspect of the inventions, the stepped radial positioning means includes a threaded coupling between the extension means and slave assembly allowing the slave assembly to rotate. It also includes teeth on the adjacent ends of the extension means and the slave assembly which mesh to hold the orientation selected. A locking collar can be pulled back to separate the teeth and allow the slave assembly to rotate.

In accordance with another preferred embodiment of the invention, a supplementary extension is provided for extending the length between the handle assembly and the jaws. The supplementary extension has ends which work with the preexisting ends on the extension means and slave assembly. Additional supplementary extensions can be added as needed.

In this manner a locking extension pliers is provided which offers complete flexibility with respect to jaw and cutter configurations and length of the extension.

Other features and advantages of the present invention will become apparent from the following detailed description, taken in conjunction with the accompanying drawings, which illustrate, by way of example, the principles of the invention.

BEST MODES FOR CARRYING OUT THE INVENTION

Figures 1, 2, 3:
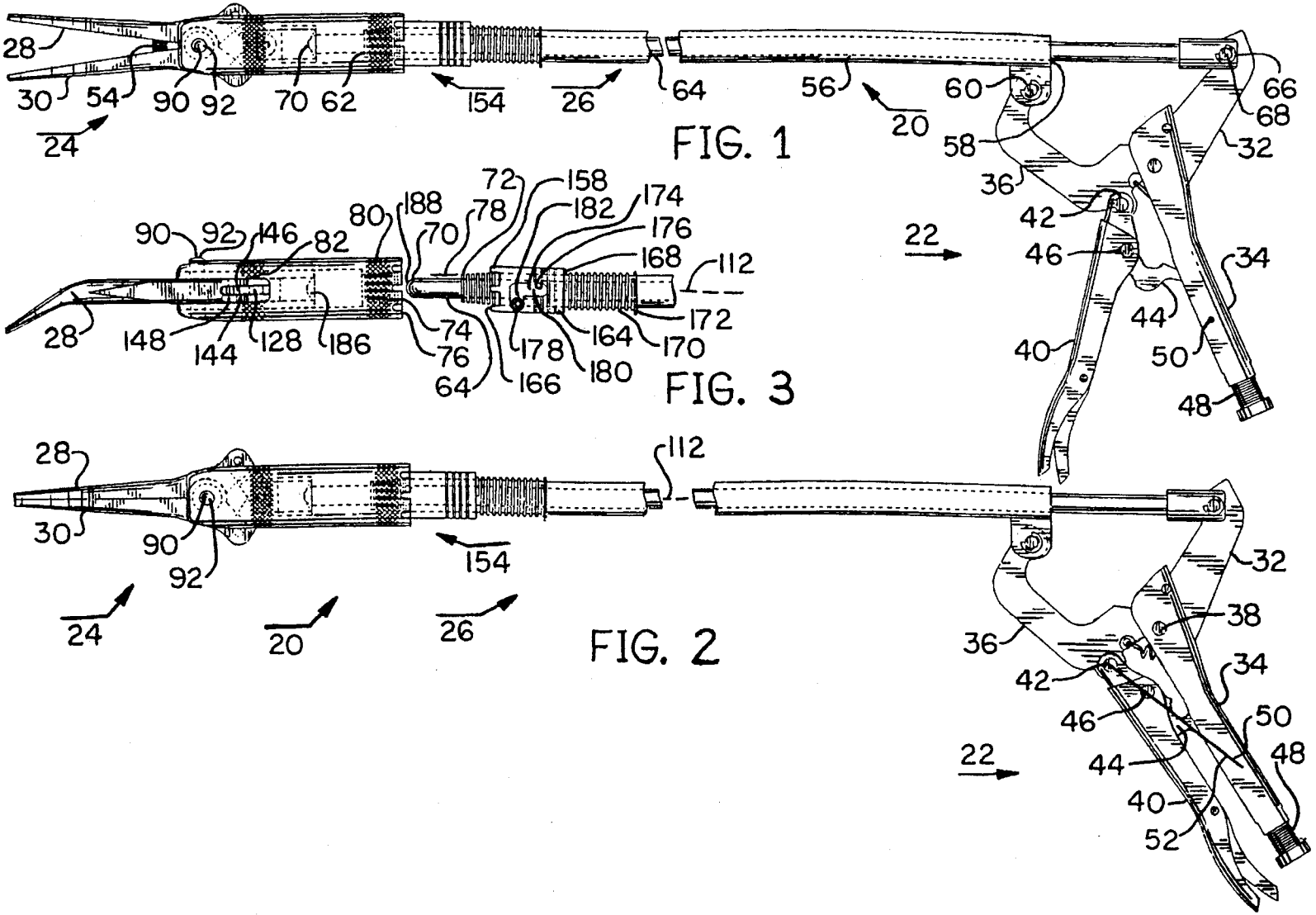
FIG. 1 is a side elevation view of an extension locking pliers with a slave assembly having bend needle nose jaws in accordance with the present invention.
FIG. 2 is the same view as FIG. 1 but with the jaws closed.
FIG. 3 is a view of the end of the pliers rotated 90° and the slave assembly unscrewed.

Referring initially to FIG. 1, an extension locking pliers is shown, generally designated 20, in accordance with the present invention. The pliers has a locking pliers handle assembly 22, a slave assembly 24, and an extension means 26 for operating the slave assembly from the handle assembly. The handle assembly 22 has all of the functional features of a locking plier such as described in the prior art cited above which is incorporated herein by reference. One common trademark for locking pliers is Vise-Grip which has available a wide variety of jaw types. The particular configuration shown in FIG. 1 is found in U.S. Pat. No. 5,056,385 and is described as a C-clamp version. The present device is not limited to this version and may have other handle assemblies depending upon the angle desired between the handle assembly 22 and the extension means 26.

FIG. 2 is the same view as FIG. 1 but with the first and second jaws 28 and 30 closed and the handle assembly 22 in the locked position. The locking of the handle assembly occurs in the manner described in the above referenced patents. Briefly, a first arm 32 is rigidly coupled to a first handle member 34 whereas a second arm 36 rotates on the first handle member 34 about a pivot 38. A second handle member 40 is rotatably coupled to the second arm 36 about a pivot 42. Between the two handle members is a toggle link 44 which is rotatably coupled to the second handle member 40 at a pivot 46. The other end of the toggle link 44 presses against a pivot inside the first handle member 34 at the end of an adjustment screw 48 inside the first handle member 34 represented by the point 50. The relative movement of the parts of the locking handle assembly between the open and closed positions is shown in FIGS. 1 and 2. The locking handle assembly 22 locks when the pivot 46 moves to the right of the line 52 between the pivot points 42 and 50. (U.S. Pat. No. 3,192,804 shows the same line and pivot points in FIG. 1.) When the locking handle assembly 22 is in the position represent in FIG. 2 and is subjected to force tending to push the first and second arms 32, 36 apart, the force is transmitted to the toggle link 44 pushing it further to the right making the opening of the arms and the handle members 34 and 40 even more difficult. This locking feature is contrary to the result in ordinary pliers where force tending to separate the jaws directly tends to separate the handles.

The purpose of the present invention is to separate the jaws of the locking pliers from the handles making it possible to reach the jaws into positions which are impossible, uncomfortable, or dangerous to reach with an ordinary locking pliers. A length of 65 centimeters between the tips of the jaws and the rear of the handle assembly has been found to be useful. This length can be extended by supplementary extensions as far as needed such as the 110 centimeter length shown in FIG. 11. The slave assembly 24 translates the force created by the movement of the handle members 34, 40 into movement of the jaws 28, 30. A compression spring 54 is used to keep the jaws normally open as seen in FIG. 1. When the handle members 34, 40 are squeezed together as shown in FIG. 2., the jaws 28, 30 of the slave assembly close.

The connection between the slave assembly 24 and handle assembly 22 is provided by the extension means 26. The extension means 26 has a tube 56 with a handle end 58 coupled to the second arm 36 of the handle assembly 22 by a pivot 60 and a slave end 62 coupled to the slave assembly 24. A rigid rod 64 is inserted into the tube 56 having a handle end 66 coupled to the first handle 32 by a pivot 68 and a slave end 70 operating the slave assembly 24. When the second handle member 40 is squeezed toward the first handle member 34, the second arm 36 rotates slightly on the pivot 60 while the first handle member 34 pushes the rod 64 into the tube 56. In turn the end 62 of the tube remains relatively stationary holding the slave assembly 24 while the end 70 of the rod pushes the jaws 28 and 30 closed. In this manner, the force normally associated with a locking pliers is transmitted to remotely located jaws.

FIG. 3 is a view of the jaw end of the pliers rotated 90° from the views in FIGS. 1 and 2 with the slave assembly 24 unscrewed. Standard bent nose needle nose jaws 28 and 30 are featured. All of the different pliers jaws and cutters available on standard and specialty pliers and cutters could be adapted for the present device instead of the bent nose jaws shown. While it would be possible to construct the handle assembly, extension means, and slave assembly with a single unitary construction, it is advantageous, because of the relatively high cost of the locking extension pliers, to construct the slave assembly as a removable unit in order to be able to install different jaws and cutters and to install supplementary extensions between the extension means and slave assembly as needed. Other jaws and a supplementary extension are shown in FIGS. 10–14 below. In this manner, the locking extension pliers of the present invention is designed to appeal to the mechanic who is familiar with standard socket sets with interchangeable socket sizes and extensions.

As seen in FIG. 3, the coupling means between the tube 56 and the slave assembly 24 includes male threads 72 on the tube end 62 which screw into female threads 74 in the slave assembly end 76. The threads provide a stable connection for resisting the substantial forces between the extension means 26 and the slave assembly 24. Further stability is provided by fabricating the threads with a taper represented by the line 78 which is an extension of a line across the surface of the male threads 72. The female threads 74 are correspondingly tapered as can be seen in shadow outline to the left beneath the knurling 80 on the surface of the slave assembly 24. The knurling 80 and 82 facilitates the grasping of the slave assembly as it is screwed onto the tube 56. The threads are tapered in a manner commonly found in pipe joints in order to provide increasing friction between the tube and slave assembly as they are screwed together. A point will be quickly reached where it will be exceedingly difficult to screw them together further. They will then be rigidly coupled without the necessity for jamb nuts as would be required for straight threads. Extreme rigidity is a desirable feature between the handle assembly 22 and slave assembly 24.

Figures 4, 5, 6, 7, 8, 9, 10, 11, 12:
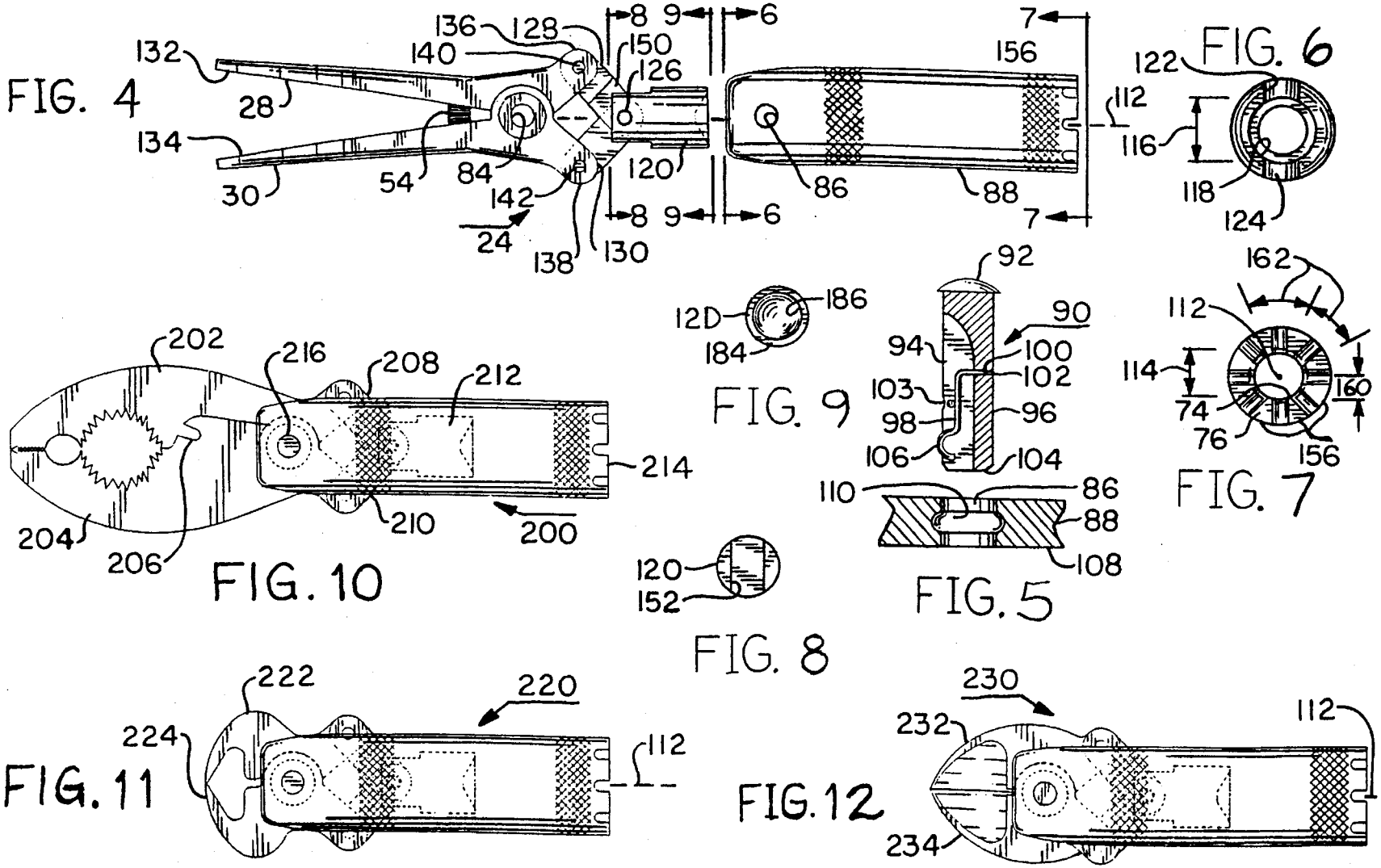
FIG. 4 is an enlarged side elevation view of the slave assembly of FIG. 1 partially disassembled.
FIG. 5 is a further enlarged side view of the jaw pivot.
FIG. 6 is a view of the casing along the line 6—6 of FIG. 4.
FIG. 7 is a view of the casing along the line 7—7 of FIG. 4.
FIG. 8 is a view of the slide along the line 8—8 of FIG, 4.
FIG. 9 is a view of the slide along the line 9—9 of FIG. 4.
FIG. 10 is a side elevation view of a second embodiment of the slave assembly with jaws for holding cylindrical objects and having a wire cutter.
FIG. 11 is a side elevation view of a third embodiment of the slave assembly with cutter jaws perpendicular to the axis of the pliers.
FIG. 12 is a side elevation view of a fourth embodiment of the slave assembly with cutter jaws coaxial with the axis of the pliers.

FIG. 4 is an enlarged side elevation view of the slave assembly 24 of FIG. 1 partially disassembled. Both jaws 28 and 30 are mounted on a jaw pivot 90 (FIGS. 1–3) which passes through the aperture 84 at the axis of the two jaws and is held in the cylindrical aperture 86 in the casing 88.

FIG. 5 shows a greatly enlarged sectional view of the jaw pivot 90. The jaw pivot 90 has a special construction allowing it to be easily pushed out of the casing 88 when desired to release the jaws for replacement by jaws or cutters having other configurations. The removable jaw pivot 90 provides an alternative way for changing the jaws or cutters instead of unscrewing the entire slave assembly as shown in FIG. 3. A longitudinal slot 94 is cut partially along the cylindrical body 96 allowing a resilient means such as a spring 98 to be inserted inside. The side of the jaw pivot 90 opposite the view of FIG. 5 is a mirror image of the view shown. The slot 94 is sufficiently wide to allow the spring 98 to move freely. The end 100 of the spring is retained in the bottom of the slot in a hole 102 and is bent 90° to project down the slot toward the insertion end 104 of the pivot where it emerges in a curve 106 from the slot adjacent the insertion end. A crimp 103 closes the slot 94 to further retain the spring 98. Shown immediately below the jaw pivot 90 is a sectional view of the sidewall 108 of the casing 88 through the center of the cylindrical aperture 86. The head 92 of the jaw pivot 90 is sufficiently large to not be able to pass through the aperture and therefore stops the head end of the pivot outside the casing. A groove 110 is constructed in the side wall around the aperture for holding the curve 106 of the spring 98. When the insertion end 104 of the jaw pivot 90 is pushed into the aperture 86, the curve 106 of the spring 98 is initially pushed entirely inside the slot 94 until the curve reaches the groove 110 where it snaps out locking the pivot in the aperture.

FIGS. 6 and 7 are views of the casing 88 along the lines 6—6 and 7—7 of FIG. 4, respectively. The casing is substantially cylindrical having a longitudinal axis 112. The tube end 76 in FIG. 7 has a bore diameter 114 with female threads 74 matching the male threads 72 on the end of the tube 56 shown in FIG. 3. The slide bore diameter 116 on the jaw end 118 in FIG. 6 is slightly larger providing a slide aperture 118 for accepting a slide 120 attached to the jaws 28, 30. Reliefs 122 and 124 are for the slide mechanism.

FIGS. 8 and 9 are views of the slide 120 only along the lines 8—8 and 9—9 of FIG. 4, respectively, showing that it is substantially cylindrical. The slide 120 interfaces with the rod 64 (FIGS. 1–3) to translate the linear motion of the rod into the lateral motion of the jaws 28, 30. The slide has a slide pivot 126 coupled to first and second jaw links 128, 130 which in turn are coupled to the jaws. Each jaw 28, 30 has a gripping end 132, 134, a lever end 136, 138, and a link pivot 140, 142 between the lever end and the jaw pivot 90. The first jaw link 128 is coupled between the slide pivot 126 and the link pivot 140 of the first jaw 28. The second jaw link 130 is coupled between the slide pivot 126 and the link pivot 142 of the second jaw 30. As can be seen in FIG. 3, the mounting 144 on the first jaw 28 for the link pivot 140 is provided with two arms 146, 148. The first jaw link 128 is positioned between the arms on the pivot 140. The second jaw 30 has an identical mounting for the second link pivot. The links 128, 130 are slightly different. As seen in FIG. 4, the second jaw link 130 is flat because it goes between the two arms 146, 148 and the slide pivot 126 in a straight line. The first jaw link 128 is unable to go in a straight line to the slide pivot because the second jaw link is in the way. It therefore has two arms going around the second jaw link to the slide pivot 126 in much the same manner as the two arms 146, 148 of the mounting 144 on the first jaw 28. Only the near arm 150 is shown in FIG. 4. FIG. 8 shows the end of the slide 120 where the links 128, 130 are positioned inside the slot 152 by means of the slide pivot. Strong balanced link mounts are preferred in order to provide long service under the forces encountered.

One of the features of the locking extension pliers 20 is that the jaws 28, 30 can be positioned and locked at any desired angle with respect to the handle assembly 22. This feature is particularly important where the working space for the jaws or the handle assembly is restricted. For example, when the jaws 28, 30 are in contact as in FIG. 2, a plane of contact is defined between them which is perpendicular to the page. When the jaws are in contact and are rotated 90° as in FIG. 3, the plane of contact is the same as the plane of the paper. Rotation of the jaw assembly 24 on the threads 72, 74 to any desired angle is possible with respect to the handle assembly 22.

A stepped radial positioning means 154 (FIGS. 1 and 2) is provided at the adjacent ends of the jaw assembly 24 and the extension means 26 for quickly locking and unlocking the slave assembly 24 so that the jaws 28, 30 have a plane of contact at a desired angle about the longitudinal axis 112 (FIGS. 3, 4, and 7) with respect to the handle assembly 22. The stepped radial positioning means 154 includes a plurality of teeth 156 on the tube end 76 of the casing 88 as best seen in FIGS. 7 and 4 and a corresponding plurality of teeth 158 on the slave end 62 of the tube 56 as best seen in FIG. 3. The teeth 156 and 158 are spaced circumferentially a given radius 160 from the longitudinal axis 112 and each tooth is spaced a given angle 162 from each adjacent tooth. When the teeth on the tube mesh with the teeth on the casing, the jaws are locked radially with respect to the handle assembly. Since the teeth are equally spaced and eight teeth are used, meshing can occur every 45° around the longitudinal axis. More teeth could be used to provide finer adjustments of the angle but 45° has been found to be more than adequate for most purposes.

A locking collar 164 (FIG. 3) on the slave end 62 of the tube 64 carries the teeth 158 on its slave end 166 and allows them to be withdrawn from the teeth 156 on the casing 88 by pulling on the handle end 168 to permit the slave assembly 24 to be rotated on the tube. A compression spring 170 around the tube provides a means for biasing the locking collar towards the slave end 62 of the tube. The spring 170 presses between the handle end 168 and a retainer snap ring 172 inset into the tube. While it would be possible to rotate the slave assembly 24 as desired by continuously pulling on the locking collar 164 against the spring 170, it is more convenient to have a means for selectively disengaging the locking collar from the casing 88. An L-shaped slot 174 is fabricated in the side wall 176 of the collar 164 with a stop 178 attached to the tube 56. The L-shaped slot has a first portion 180 parallel to the longitudinal axis 112 of the tube and a second portion 182 perpendicular to the first portion. The second portion is nearer to the slave end 166 of the collar than the first portion. Since the locking collar 164 is free to move on the tube, the collar normally is positioned on the tube with the stop 178 at the right end of the first portion 180 of the slot due to the bias of the spring 170. In this position, the teeth 158 extend toward and lock the slave assembly 24 with respect to the tube 56. To release the teeth, the collar is pulled along the tube until the stop 178 hits the end of the first portion 180. The locking collar 164 is then rotated on the tube 56 until the stop hits the end of the second portion 182 as shown in FIG. 3. In this position, the teeth 158 on the locking collar are pulled away from the teeth 156 on the casing 88 thereby releasing the slave assembly 24 to rotate freely. The spring 170 keeps the stop 178 in the second portion 182 of the slot by pushing the side of the slot against the stop. The collar must be manually rotated placing the stop back in the first portion of the slot before the spring can push the collar along the tube again.

It should be noted that the longitudinal axis 112 is the same for the slave assembly 24, extension means 26, tube 56, rod 64, casing 88, slide 120, and locking collar 164 when they are assembled.

In order to facilitate the changing of the slave assembly 24 on the extension means 26, the connection between the rod 64 and the slide 120 is minimized. All that is needed to transmit the compressive forces created by the handle members 34, 40 to the jaws 28, 30 is the pushing of the rod end 70 against the slide 120. No connection is required for the handle assembly to pull the slide back when the force is released as the spring 54 between the jaws 28, 30 opens them which pushes the slide when the handle assembly is released. An abutting rotatable compression transmitting means is therefore provided between the extension means 26 and the slave assembly 24 for transmitting the compressive force from the handle assembly 22 to the first and second jaws 28, 30 while allowing the rod 64 to be rotated with respect to the slave assembly. This is achieved by providing the handle end 184 of the slide 120 shown in FIGS. 9 and 4 with a uniform curved depression 186 centering about the longitudinal axis 112 preferably having a rounded cup shape and the slave end 70 of the rod 64 with a curved surface 188 centering about the longitudinal axis mirroring the uniform curved depression.

FIG. 10 is a side elevation view of a second embodiment of a slave assembly 200 with jaws 202, 204 for holding cylindrical objects and having a wire cutter 206. The links 208, 210, slide 212, casing 214, jaw pivot 216, and all other associated features are the same as in the previous embodiment. The slave assembly 200 can be substituted for the slave assembly 24 on the extension means 26. Alternatively, the jaws 202,204, links 208, and slide 212 can be removed as a unit from the casing 214 after the jaw pivot 216 has been withdrawn and substituted for the same components in the casing 88 of the previous embodiment.

FIG. 11 is a side elevation view of a third embodiment of a slave assembly 220 with cutter jaws 222, 224 perpendicular to the longitudinal axis 112 (FIGS. 2 and 3) of the extension locking pliers. All components other than the jaws are the same as in the prior embodiments.

FIG. 12 is a side elevation view of a fourth embodiment of the slave assembly 230 with cutter jaws 232, 234 coaxial with the longitudinal axis 112 (FIGS. 2 and 3) of the extension locking pliers. All components other than the jaws are the same as in the prior embodiments. Slave assemblies having jaws or cutters in any other of the hundreds of configurations found on pliers could also be fabricated and are within the scope of this disclosure.

Figure 14:
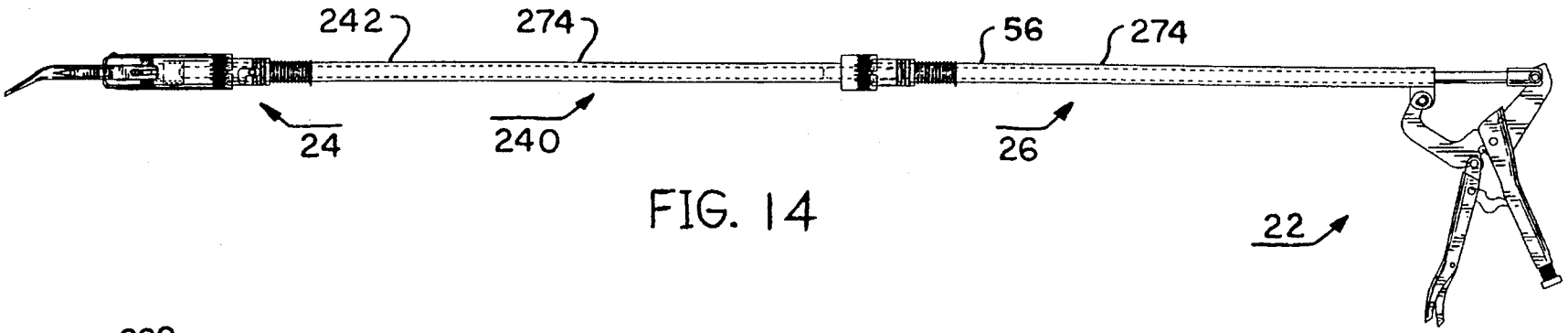
FIG. 14 is a reduced side elevation view of the complete extension locking pliers of FIG. 1 with the supplementary extension of FIG. 13 inserted between the extension means and slave assembly.
Figure 13:
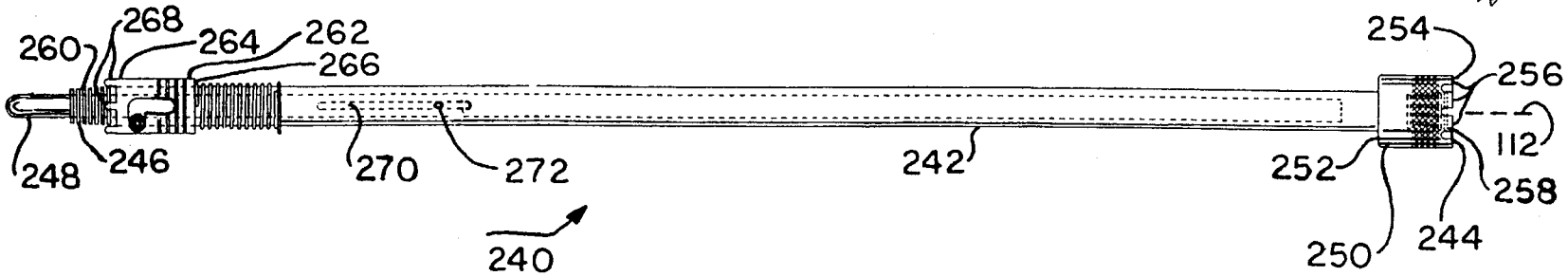
FIG. 13 is a side elevation view of a supplementary extension.

FIG. 13 is a side elevation view of a supplementary extension 240 and FIG. 14 is a reduced side elevation view of the complete extension locking pliers 20 of FIG. 1 with the supplementary extension of FIG. 13 inserted between the extension means 26 and the slave assembly 24. Additional supplementary extensions could be added between the extension means and the slave assembly as required in much the same manner as extensions are added to socket wrenches to reach remote locations. The ends of the supplementary extension 240 are designed to mate with the respective ends of the extension means 26 and the slave assembly 24.

The supplementary extension 240 has a supplementary tube 242 with a longitudinal axis 112 the same as the longitudinal axis of the first embodiment, a handle end 244, a slave end 246, and a supplementary rod 248 inserted inside. The handle end has a supplementary coupler 250 with a longitudinal axis 112, a slave end 252, and a tube end 254. The tube end 254 is identical to the tube end 76 of the casing 88 of the first embodiment because the coupler has to work in exactly the same manner. A plurality of teeth 256 are spaced circumferentially the given radius 160 (FIG. 7) from the longitudinal axis 112 and each tooth is spaced the given angle 162 from each adjacent tooth. Female threads 258 around the bore provide the same function as the female threads 74 of the casing 88 (FIG. 3). The slave end 246 is identical to the slave end 62 of the first embodiment because it has to work in exactly the same manner. Male threads 260 match the female threads in the slave assembly. A supplementary locking collar 262 is identical to the locking collar 164 and works in the same manner. The collar 262 has a longitudinal axis 112, a slave end 264, a handle end 266, and a plurality of teeth 268 on the slave end spaced circumferentially the given radius 160 (FIG. 7) from the longitudinal axis and each tooth spaced the given angle 162 from each adjacent tooth. All other details of the supplementary locking collar 262 are the same as the details for the locking collar 164.

One feature is added to the supplementary extension 240 that is not needed in the extension means 26. The rod 248 is not confined at the ends by anything when the supplementary extension is not attached to the extension pliers 20. A longitudinal slot 270 is therefore provided in the rod having a length greater than the length of any travel of the rod in use. A pin 272 is inserted through the slot 270 into the side walls of the supplementary tube 242 pinning the rod inside the tube.

A rubberized insulating coating 274 is preferably applied to the outer surface of both the tube 56 of the extension means 26 and the supplementary tube 242 of the supplementary extension 240. The coating minimizes the possibility of grounding the pliers against an electrical device, guards against heat and cold, and provides a more comfortable and higher friction gripping surface.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. An extension locking pliers, comprising:

a locking pliers handle assembly having first and second arms;

a slave assembly having:
first and second jaws;
a casing;
a jaw pivot mounting each of said first and second jaws on said casing;
a slide mounted in said casing and having a slide pivot;

each of said first and second jaws having a gripping end, a lever end, and a link pivot between said lever end and said jaw pivot;

a first jaw link mounted on said slide pivot and said link pivot of said first jaw;

a second jaw link mounted on said slide pivot and said link pivot of said second jaw; and, an extension means for operating said first and second jaws spaced from said locking pliers handle assembly having:
a tube having a tube handle end and a tube slave end;
said tube handle end coupled to one of said first and second arms;
said tube slave end coupled to said casing;
a rod inserted into said tube having a rod handle end and a rod slave end;
said rod handle end operatively engaging the other of said first and second arms; and,
said rod slave end operatively engaging said at least one of said first and second jaws mounted on said jaw pivot.

2. An extension locking pliers, comprising:

a locking pliers handle assembly having first and second arms;

a slave assembly having:
first and second jaws;
a casing;
a jaw pivot mounting each of said first and second jaws on said casing and said jaw pivot is removably fitted in said casing allowing said first and second jaws to be selectively removed from said casing when said jaw pivot is removed; and, an extension means for operating said first and second jaws spaced from said locking pliers handle assembly having:
a tube having a tube handle end and a tube slave end;
said tube handle end coupled to one of said first and second arms;
said tube slave end coupled to said casing;
a rod inserted into said tube having a rod handle end and a rod slave end;
said rod handle end operatively engaging the other of said first and second arms; and,
said rod slave end operatively engaging said at least one of said first and second jaws mounted on said jaw pivot.

3. An extension locking pliers according to claim 2, wherein:

said casing includes:
a side wall;
a cylindrical aperture through said side wall for said jaw pivot; and,
a groove in said side wall around said aperture; and,
said jaw pivot includes:
a cylindrical body; and,
a resilient means projecting from said cylindrical body selectively engaging said groove to selectively retain said jaw pivot in said cylindrical aperture.

4. An extension locking pliers according to claim 3, wherein said jaw pivot further includes:

a head end and an insertion end;

a head on said head end larger than said cylindrical aperture stopping said head end outside said casing;

said cylindrical body having a longitudinal slot;

said resilient means is a spring coupled to said jaw pivot inside said slot and projects down said slot toward said insertion end resiliently emerging adjacent said insertion end to selectively engage said groove.

5. An extension locking pliers, comprising:

a locking pliers handle assembly having first and second arms;

a slave assembly having:
first and second jaws;
a casing; and,
a jaw pivot mounting at least one of said first and second jaws on said casing;

an extension means for operating said first and second jaws spaced from said locking pliers handle assembly having:
a tube having a tube handle end and a tube slave end;
said tube handle end coupled to one of said first and second arms;
said tube slave end coupled to said casing;
a rod inserted into said tube having a rod handle end and a rod slave end;
said rod handle end operatively engaging the other of said first and second arms; and,
said rod slave end operatively engaging said at least one of said first and second jaws mounted on said jaw pivot;

said slave assembly and said tube having a longitudinal axis;

said first and second jaws having a plane of contact therebetween when closed; and, stepped radial positioning means about said longitudinal axis for positioning said first and second jaws to have a plane of contact in a selected position with respect to said handle assembly.

6. An extension locking pliers according to claim 5, wherein said stepped radial positioning means includes:

said casing having said longitudinal axis, a jaw end, a tube end, and a plurality of teeth on said tube end spaced circumferentially a given radius from said longitudinal axis and each tooth spaced equally a given angle from each adjacent tooth;

said tube having a locking collar at said slave end, said locking collar having said longitudinal axis, a slave end, a handle end, and a plurality of teeth on said slave end spaced circumferentially said given radius from said longitudinal axis and each tooth spaced equally said given angle from each adjacent tooth, said plurality of teeth on said locking collar selectively engaging said plurality of teeth on said casing; and, a rotational means coupling said tube slave end to said casing permitting said casing to be rotated about said longitudinal axis when said plurality of teeth on said locking collar are disengaged from said plurality of teeth on said casing.

7. An extension locking pliers according to claim 6, wherein said rotational means coupling said tube slave end to said casing are male threads on said slave end of said tube and female threads in said tube end of said casing.

8. An extension locking pliers according to claim 7, wherein said female and male threads are tapered threads causing increased friction between said tube and casing as said tube and casing are rotated together.

9. An extension locking pliers according to claim 7, further including a rotatable compression transmitting means between said extension means and said slave assembly for transmitting a compressive force from said locking pliers handle assembly to said first and second jaws.

10. An extension locking pliers according to claim 9, wherein said rotatable compression transmitting means includes:

said casing having a slide mounted therein and movable along said longitudinal axis, said slide having a jaw end and a tube end, and said tube end having a uniform curved depression centering about said longitudinal axis; and, said rod having said longitudinal axis and said slave end of said rod having a curved surface centering about said longitudinal axis mirroring said uniform curved depression.

11. An extension pliers according to claim 10, wherein said uniform depression has a rounded cup shape.

12. An extension pliers according to claim 10, further including a means for biasing said first and second jaws apart.

13. An extension pliers according to claim 12, wherein said jaw biasing means is a spring between said first and second jaws.

14. An extension locking pliers according to claim 6, wherein said tube further includes a means for biasing said locking collar toward said slave end.

15. An extension locking pliers according to claim 14, wherein said locking collar biasing means is a compression spring around said tube pressing between said handle end of said locking collar and a retainer coupled to said tube.

16. An extension locking pliers according to claim 15, wherein said tube further includes a means for selectively disengaging said locking collar from said casings said disengaging means having:

said locking collar rotating and moving on said tube and said locking collar further including a side wall and an L-shaped slot through said side walls said L-shaped slot having a first portion parallel to said longitudinal axis and a second portion perpendicular to said first portion, said second portion nearer to said slave end than said first portion; and, said tube further including a stop coupled to said tube inside said L-shaped slot.

17. An extension locking pliers according to claim 7, further including a supplementary extension including:

a supplementary tube having:

a handle end having a supplementary coupler having said longitudinal axis, a jaw end, a tube end, a plurality of teeth on said tube end spaced circumferentially said given radius from said longitudinal axis and each tooth spaced said given angle from each adjacent tooth, and female threads;

a slave end having male threads and a supplementary locking collar having said longitudinal axis, a slave end, a handle end, and a plurality of teeth on said slave end spaced circumferentially said given radius from said longitudinal axis and each tooth spaced said given angle from each adjacent tooth; and, a supplementary rod inserted into said supplementary tube.

18. An extension locking pliers according to claim 17, further including a rubberized insulating coating on said tube and said supplementary tube.

19. An extension locking pliers, comprising:

a locking pliers handle assembly having:

first and second arms;

a slave assembly having:

first and second jaws having a plane of contact therebetween when closed, each jaw having a gripping end, a lever end, and a link pivot between said lever end and said jaw pivot;

a casing having a longitudinal axis, a jaw end, and a tube end having female threads inside and a plurality of teeth spaced circumferentially a given radius distance from said longitudinal axis and each tooth spaced a given angle from each adjacent tooth;

a jaw pivot mounting both said first and second jaws on said casing;

a slide mounted in said casing and having a slide pivot;

a first jaw link mounted on said slide pivot and said link pivot of said first jaw; and, a second jaw link mounted on said slide pivot and said link pivot of said second jaw;

an extension means having:

a tube having said longitudinal axis, a tube handle ends and a tube slave end, said tube handle end coupled to one of said first and second arms, and said tube slave end having male thread coupled to said female thread in said casing; and, a locking collar at said tube slave end having a slave end, a handle end, and a plurality of teeth on said slave end spaced circumferentially said given radius from said longitudinal axis and each tooth spaced said given angle from each adjacent tooth, said plurality of teeth on said locking collar selectively engaging said plurality of teeth on said casing; and, a means for biasing said locking collar toward said slave end having a compression spring around said tube pressing between said handle end of said locking collar and a retainer coupled to said tube;

a rod inserted into said tube having a rod handle end and a rod slave ends said rod handle end operatively engaging the other of said first and second arms, and said rod slave end operatively engaging said at least one of said first and second jaws mounted on said jaw pivot.

* * * * *